US005509571A

United States Patent [19]

Weber

[11] Patent Number: 5,509,571

[45] Date of Patent: Apr. 23, 1996

[54] PLUG-IN DISPENSER FOR SANITARY-HYGIENE ITEMS OR THE LIKE

[75] Inventor: Franz Weber, Erkrath, Germany

[73] Assignee: DRL Hygiene-Systeme GmbH, Erkrath, Germany

[21] Appl. No.: 271,427

[22] Filed: Jul. 7, 1994

[30] Foreign Application Priority Data

Jul. 14, 1993 [DE] Germany ..... 43 23 473.9

[51] Int. Cl.[6] ..... B65H 1/04

[52] U.S. Cl. ..... 221/46; 221/49; 221/197; 221/198; 221/286; 221/287

[58] Field of Search ..... 221/45, 46, 47, 221/49, 197, 198, 282, 286, 287, 312 B

[56] References Cited

U.S. PATENT DOCUMENTS 3,784,055 1/1974 Anderson ..... 221/46
5,143,252 9/1992 Shi ..... 221/287 X

FOREIGN PATENT DOCUMENTS 497293 1/1939 United Kingdom ..... 221/46 X

*Primary Examiner*—William E. Terrell
*Assistant Examiner*—Dean A. Reichard
*Attorney, Agent, or Firm*—Pearne, Gordon, McCoy & Granger

[57] ABSTRACT

The invention relates to a dispenser for sanitary-hygiene items, such as bags which can be folded up, handkerchiefs, or the like, comprising a box-type housing and a container of a flexible material, such as cardboard, which is exchangeably arranged in the housing and contains the sanitary-hygiene items, the housing of which dispenser comprises at least one projection which projects into the interior of said housing, and the container is provided, in the region of the projections, with predetermined breaking points for puncturing by the projections.

13 Claims, 1 Drawing Sheet

PLUG-IN DISPENSER FOR SANITARY-HYGIENE ITEMS OR THE LIKE

Figure 1:
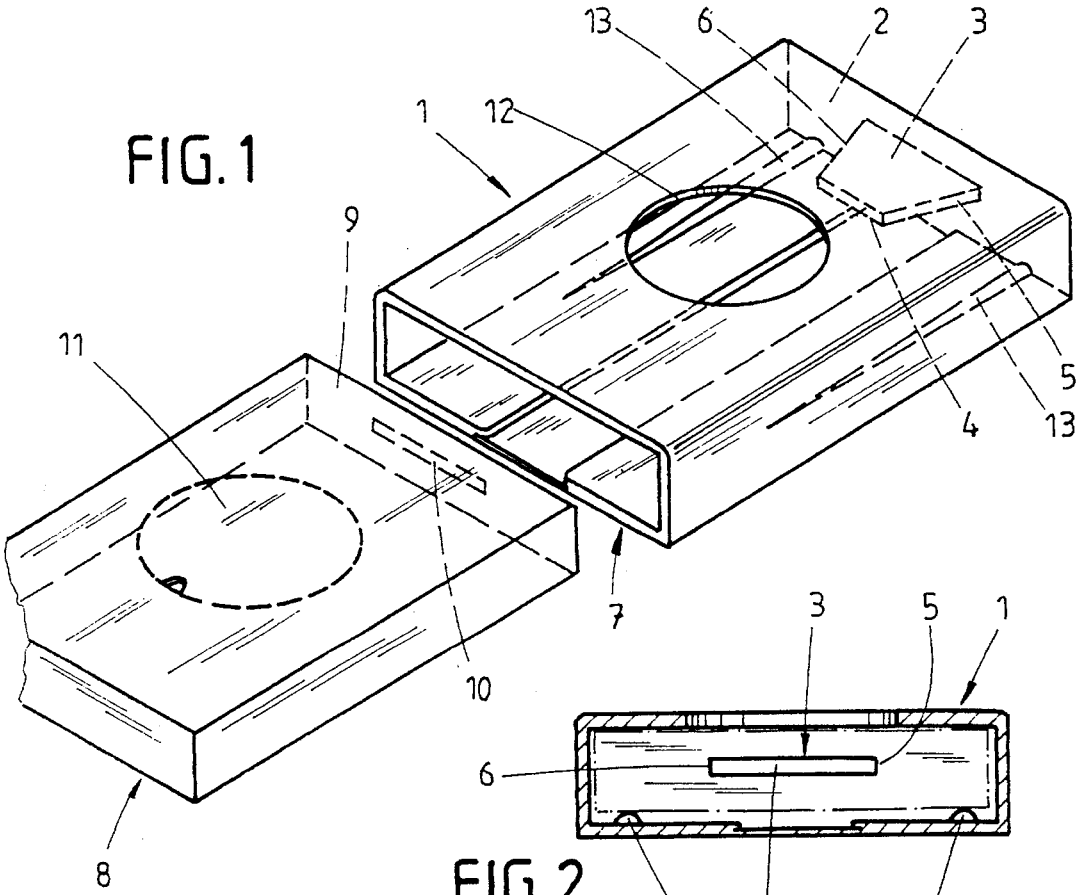

The invention relates to a dispenser for sanitary-hygiene items, such as bags which can be folded up, handkerchiefs, or the like, comprising a box-type housing and a container of a flexible material, such as cardboard, which is exchangeably arranged in the housing and contains the sanitary-hygiene items.

A known dispensing device of this kind (EP-0 381 821 A1) is composed of two parts and comprises a tray-like lower part which is to be attached to the wall and in which a cardboard container for sanitary-hygiene items may be inserted, whereupon the unit is locked by a hood-like top cover, which can be attached by means of a snap-on locking means, and the sanitary-hygiene items are pulled out through a central opening in said cover. The two-part housing of the known device is relatively expensive, since it is designed, in part, to be double-walled, thus involving a relatively large quantity of material. In addition, two injection molds are required for the manufacture of the two-part housing, and this causes additional expense. It is for this reason that the known device is generally justified only for the purpose of meeting select demands.

Another known dispenser (DE Design 91 07 537.8) comprises a box-type housing which is designed as a closed rigid box which is open on an end face for the purpose of inserting and withdrawing an exchangeable container, of cardboard or the like, which contains the sanitary-hygiene items. At its rear side, the housing is provided with holding means in the form of elongate holes, self-adhesive strips, or the like, to permit attaching said housing to a wall, such as the wall of a bathroom, and the front face of said housing comprises an opening which must be aligned with a corresponding opening in the inserted container, such that it is possible to pull, individually and successively, the sanitary-hygiene items, which are contained in a folded-up form in the inserted container, through said opening, thereby removing said items. The interior of the housing is provided with projections in the form of wedge-shaped ridges which taper in the direction of the open end face of the housing, for the purpose of securing the inserted container in a clamping manner.

Said plug-in dispenser is usually used in hotels and restaurants. In that case, the box is attached to a wall, such as a bathroom wall, usually with the plug-in opening facing in a downward direction. This has the advantage that water splashes do not penetrate from above into the box and, thus, into the container containing the sanitary-hygiene items. In the case of an arrangement in which the open end face faces in a downward direction, said open end face is not exposed to the view of the user, which is also desirable for esthetic reasons.

It has, however, been found that the securing, downwardly tapering ridges do not always provide sufficient support for the cardboard box in the dispenser. This is due to various reasons. Firstly, it was frequently noted that the staff replenishing the plug-in dispensers often do not insert the refill cardboard box completely into the plug-in dispenser, a factor which is partially attributable to the fact that no contact point needs to be overcome for the complete insertion of the package into the plug-in dispenser, nor is any sound audible when the package is fully inserted. The result is that the refill cardboard box is pressed only incompletely against the projections and slowly falls out downwardly as a result of vibrations.

A second difficulty resulted from the fact that, in a room such as a bath, various sanitary-hygiene items, such as bags which can be folded, handkerchiefs, or the like, must be held in readiness simultaneously. To this end, a plurality of dispensers is required. Since the dispensers are usually suspended at various points in a room, such as, for example, a bathroom, it is necessary that it should be possible to hold a certain sanitary-hygiene item in readiness in a specific dispenser. This may readily result in an incorrect replacement of different sanitary-hygiene items.

A further difficulty resides in that it is possible for cartons filled with inferior products to be inserted in the dispensers. Cartons filled in this manner are usually offered by low-price manufacturers.

SUMMARY OF THE INVENTION

The invention is thus based on the object of providing a dispenser which permits an improved securing of the inserted container and which prevents an incorrect replenishing of various containers which are to be inserted and contain specific sanitary-hygiene items. In addition, the complete stop of the container in the dispenser is to be indicated in a distinct manner.

In addition, it is to be prevented that cartons filled with inferior sanitary-hygiene items be transferred into the dispensers.

According to the invention, this object is met by a device of the kind described at the outset in which the housing comprises at least one projection which projects into the interior of said housing, and the container is provided, in the region of the projections, with predetermined breaking points for puncturing by the projections.

The projections may be designed to be free-standing flanges, pins, conical pegs or barbs, and to be integral with that wall of the housing on which they are located.

Conveniently, the surface of the projections may be roughened.

The transverse sides of the projections which are designed as a flange extend at an angle toward each other and the flange thus tapers in a wedge-like manner in the direction of its free end.

If desired, the projection which is designed as a flange may be provided, at its free end, with an arrow-like profile.

The projection which is designed as a conical peg may be provided with an arrow-like outer head.

Conveniently, the housing is constructed, for example, injection-molded, in a single piece of plastics material and comprises an open end face, at least one projection, which projects into the housing, being molded onto that end wall of the housing which is disposed opposite the open end of the housing.

The predetermined breaking points may be perforations in the walls of the container.

In contrast to the known prior art, a device, which makes it possible to increase the support of the container, and which provides a signal in the form of a contact point to be overcome and a clearly audible sound, which indicates the complete insertion of the container and prevents containers with incorrect sanitary-hygiene items from being accommodated in the dispensers, is provided in the interior of the device according to the invention. In addition, said device permits a more ready withdrawal of the contents of the container.

According to a particularly preferred embodiment of the invention, a wedge-shaped projection, the long side of which is directed parallel relative to the front and rear walls of the housing, is attached centrally to the inner surface of the end face disposed opposite the opening. The container to be inserted is provided with a predetermined breaking point in the form of a perforated line which has the identical shape, length and position as the free end of the projection. When the container is inserted, it is pressed against said projection where it must overcome a resistance in the form of a contact point, the free end of the projection, as a result of the pressure, breaking through the container along the perforated line of the container, whereupon the container is fully inserted into the housing against the pressure of wedge-shaped ribs and of the projection. In addition, the projection increases the friction between carton and housing, as a result of which the support of the container in the housing is increased. Said friction may be increased if the projection is provided with an enlarged surface in the form of surface-roughness or the like.

As a result of different arrangements of individual projections, or a plurality of projections, on the inner surface of the end face opposite the opening, on the one hand, and various forms of predetermined breaking points on the container, on the other hand, the means are provided to ensure that only specific containers, which are filled with a specific sanitary-hygiene item, are inserted into a housing which is provided with a specific projection.

In addition, it is advantageously ensured that the projection or projections exert or exerts a pressure on the contents of the container, as a result of which the contents can be withdrawn more readily.

Figure 2:
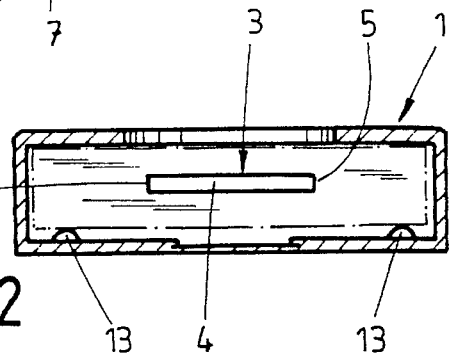
Figure 3:
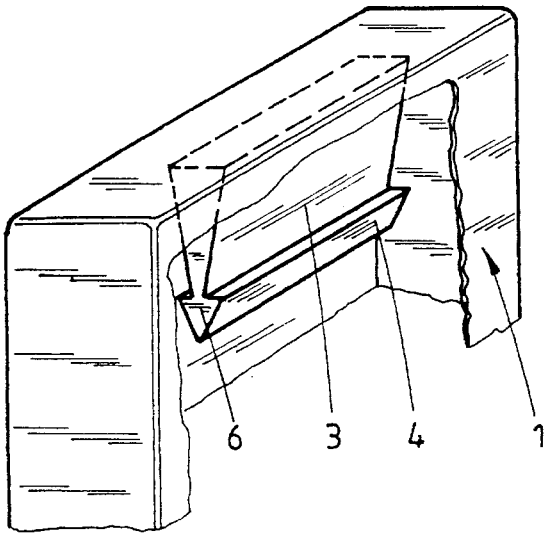

An exemplified embodiment of the dispenser according to the invention is diagrammatically illustrated in the drawing, in which FIG. 1 shows a graphic representation of the device at an angle from above, a container, which is to be plugged into the housing of the device, being shown upstream of the housing, FIG. 2 shows a cross-section of the device, FIG. 3 shows a vertical section of the housing, which is provided with an alternatively designed projection, at an angle from the front.

The plug-in dispenser shown in FIGS. 1 and 2 comprises a housing (1) in which a projection (3), which is designed as a flange, is attached to the inner surface of the upper end face (2) and which comprises a free end (4) and two lateral edges (5 and 6). The two lateral edges (5 and 6) taper in the direction of the free end (4), such that the flange (3) is designed to be wedge-shaped. An opening (12) on the front face of the housing (1) serves to permit sanitary-hygiene items, such as bags, handkerchiefs, or the like, to be withdrawn from a container (8) which is to be inserted. An upper edge (9) of the container (8) is provided with a predetermined breaking point, in the form of a perforated line (10), which corresponds to the position, shape and length of the lower edge (4) of the flange (3). The container (8) is also provided with an opening (11) which must be aligned with the opening (12) of the housing (1), in order to permit sanitary-hygiene items to be withdrawn from the container.

On the surface opposite the opening (12) of the housing (1), ribs (13) are provided within the housing, which ribs are designed to be wedge-shaped or conical and commence in the middle region and increase in their height and width in the direction of the end face (2), at which they terminate. The upper side of the ribs (13) is rounded off. The ribs (13) serve to press the upper side of the inserted container (8) from within against that wall of the housing (1) which comprises the opening, in order that the container (8) be secured in the housing (1) by frictional contact. The wedge-like shape of the ribs (13) facilitates the insertion of containers (8).

In a preferred arrangement, the housing is attached to a wall, such as a bathroom wall, in a manner such that a bottom opening (7), which is disposed opposite the end face (2) of the housing (1), is directed vertically downward. The container (8) is inserted into said opening (7) of the housing (1). When the upper edge (9) of the container (8) abuts against the free end (4) of the projection (3) in the housing (1), a pressure, which must be overcome for the complete insertion of the container (8), is produced. If the pressure is overcome, the free end (4) of the projection (3) breaks through the perforation line (10) of the container (8), as a result of which the container can be fully inserted up to the complete abutment of the upper edge (9) of the container (8) against the top end face (2) of the housing. Friction is caused between the container (8) and the projection (3) of the housing (1) along the perforation line (10) in the upper edge (9) of the container (8). Since the contents of the container (8), being in the form of sanitary bags, handkerchiefs, or the like, are flexible, the projection (3) does not spoil the contents, but the projection (3) rather causes said contents to be pressed downward, thereby reducing the volume in the container (8). As a result hereof, the contents of the container (8) are more readily withdrawn therefrom.

An alternative embodiment of the flange (3) is illustrated in FIG. 3, the lower end (4) of the projection (3) having an arrow-like cross-section, as a result of which the free end (4) serves as a barb and increases the support of the container (8) in the housing (1).

One or more flanges, pins, or the like can be attached in the interior of the housing (1), as desired, resulting in a wide range of dispenser variations. When the containers, which contain the sanitary-hygiene items, are provided with appropriate predetermined breaking points, they can be inserted only in a specific variation of the dispenser. As a result hereof, the possibility that specific sanitary-hygiene items are transferred into a dispenser for which said items are not intended, is precluded. If it is necessary to suspend a plurality of dispensers for a plurality of sanitary-hygiene items in a room, such as a bathroom, the dispensers can be supplied only with the sanitary-hygiene items which are, in each case, intended therefor, due to the differing arrangements of the flanges, pins, or the like. It is thereby, at the same time, prevented that inferior products are transferred into the dispensers.

I claim:

1. Dispenser for sanitary-hygiene items, comprising a box-type housing having an upper end wall connected to sidewalls extending to an open bottom oppositely disposed from the upper end wall and a container of a flexible material which is exchangeably arranged in the housing and contains the sanitary-hygiene items, the container being mounted in and removed from the housing by movement through the open bottom along a first direction, the housing upper end wall having at least one projection which projects in said first direction into the interior of said housing for puncturing engagement with the container, the container having predetermined breaking points in the region of the projection, at least one of the housing sideways having at least one rib extending into the housing to bias the container in a second direction extending laterally to the first direction to thereby cause proper engagement of the container by the projection at the breaking points.

2. Dispenser according to claim 1, characterized in that the projection is designed to be free-standing flanges, pins, conical pegs or barbs.

3. Dispenser according to claim 1, characterized in that the projection is designed to be integral with that wall of the housing on which they are located.

4. Dispenser according to claim 1, characterized in that the surface of the projection is roughened.

5. Dispenser according to claim 1, characterized in that the projection includes transverse sides and is designed as a flange having a free end, the transverse sides extend at an angle toward each other and the flange thus tapers in a wedge-like manner in the direction of its free end.

6. Dispenser according to claim 1, characterized in that the projection is designed as a flange and is provided, at its free end, with an arrow-like profile.

7. Dispenser according to claim 1, characterized in that the projection is designed as a conical peg and is provided with an arrow-like outer head.

8. Dispenser according to claim 1, characterized in that the housing is constructed, in a single piece of plastics material.

9. Dispenser according to claim 1, characterized in that the predetermined breaking points are perforations in the flexible material of the container.

10. Dispenser for sanitary-hygiene items, comprising a box-type housing and a container of a flexible material which is exchangeably arranged in the housing and contains the sanitary-hygiene items, the housing including at least one projection which projects into the interior of said housing, and the container is provided, in the region of the projection, with predetermined breaking points for puncturing by the projection, said projection having a flange configuration including a free end with an arrow-like profile.

11. Dispenser for sanitary-hygiene items, comprising a box-type housing and a container of a flexible material which is exchangeably arranged in the housing and contains the sanitary-hygiene items, the housing including at least one projection which projects into the interior of said housing, and the container is provided, in the region of the projection, with predetermined breaking points for puncturing by the projection, said projection having a conical peg configuration including an arrow-like profile.

12. Dispenser according to claim 10, wherein the container is mounted in and removed from the housing by movement along a longitudinally extending direction in the interior of said housing, and said at least one projection projects into the interior of said housing in said longitudinal direction.

13. Dispenser according to claim 11, wherein the container is mounted in and removed from the housing by movement along a longitudinally direction in the interior of said housing, and said at least one projection projects into the interior of said housing in said direction.

* * * * *